US006692076B1

(12) United States Patent
Burer

(10) Patent No.: US 6,692,076 B1
(45) Date of Patent: Feb. 17, 2004

(54) BOLSTER CHAIR WITH FOLDABLE SEAT THAT IS VERTICALLY ADJUSTABLE WHEN FOLDED INTO A VERTICAL POSITION

(76) Inventor: Peter J. Burer, 10720 72nd St., Suite 304, Largo, FL (US) 33777

( * ) Notice: Subject to any disclaimer, the term of this patent is extended or adjusted under 35 U.S.C. 154(b) by 0 days.

(21) Appl. No.: 09/683,688

(22) Filed: Feb. 4, 2002

(51) Int. Cl.[7] ..... A47C 1/02
(52) U.S. Cl. ..... 297/331; 297/338; 297/464
(58) Field of Search ..... 297/14, 331, 332, 297/335, 338, 464

(56) References Cited

U.S. PATENT DOCUMENTS

| | | | | | |
|---|---|---|---|---|---|
| 146,432 | A | * | 1/1874 | Close | 297/331 |
| 1,264,609 | A | * | 4/1918 | Burness, Jr. | 248/407 |
| 1,428,018 | A | * | 9/1922 | Erickson | 297/332 |
| 3,428,976 | A | * | 2/1969 | Robinson | 114/363 |
| 3,477,673 | A | * | 11/1969 | Bereday | 248/121 |
| 3,594,037 | A | * | 7/1971 | Sherman | 297/14 |
| 4,251,100 | A | * | 2/1981 | Rolandelli | 296/63 |
| 4,787,675 | A | * | 11/1988 | McLeod | 297/335 |
| 4,803,945 | A | * | 2/1989 | Adams et al. | 114/363 |
| 5,295,728 | A | * | 3/1994 | Schaevitz | 297/195.1 |
| 5,619,949 | A | * | 4/1997 | Dick, Jr. | 114/363 |
| 5,788,015 | A | * | 8/1998 | Seng et al. | 187/222 |
| 6,189,964 | B1 | * | 2/2001 | Henshaw et al. | 297/112 |
| 6,267,071 | B1 | * | 7/2001 | Ellis | 114/363 |

* cited by examiner

*Primary Examiner*—Peter M. Cuomo
*Assistant Examiner*—Joseph Edell
(74) *Attorney, Agent, or Firm*—Ronald E. Smith; Smith & Hopen, P. A.

(57) ABSTRACT

A bolster chair includes a seat having a horizontal position to support a seated user and an upwardly folded vertical position where it enables a user to stand in a space bordered by back and side walls of the bolster chair. The vertical position of the seat is height adjustable so that users of differing heights may lean against the seat when standing in the bordered space. When the seat is in its vertical configuration, the user may displace a handle in a first direction to lock the plunger and the seat into a position of vertical adjustment and to cause a pair of locking members to extend and to lock the seat so that it cannot be folded into a horizontal position. Displacing the handle in an opposite direction releases a gas spring plunger to unlock the seat for vertical adjustment and retracts the pair of locking members.

7 Claims, 5 Drawing Sheets

BOLSTER CHAIR WITH FOLDABLE SEAT THAT IS VERTICALLY ADJUSTABLE WHEN FOLDED INTO A VERTICAL POSITION

BACKGROUND OF THE INVENTION

1. Field of the Invention

This invention relates, generally, to bolster chairs. More particularly, it relates to a bolster chair having a seat that is movable between a horizontal and a vertical position and which is vertically adjustable when in the vertical position.

2. Description of the Prior Art

Bolster chairs are typically found on vehicles such as speedboats. However, they also have utility on other vehicles that experience turbulent motion. Bolster chairs are large, heavily padded chairs that include aback wall and a pair of side walls. They typically include a drop down foldable seat having a horizontal disposition that provides a conventional seat means for use when the forces being applied to the seat are not particularly violent. The foldable seat also includes a folded downwardly, vertical position where it lacks utility as a seat means. The downwardly folded position is used when the speed of the boat or other vehicle is so high that violent forces are transmitted to the seat and sitting becomes uncomfortable. In that event, the user folds the seat downwardly into a vertical position and stands within an area bordered on the rear by the back of the chair and bordered on both sides by the side walls of the chair. The legs are bent slightly to better absorb the forces transmitted to the user. The back and the sides of the bolster chair provide heavily cushioned support means that prevents the user from falling to the rear or to either side, and the forward progress of the vehicle is sufficient to prevent the user from falling forward.

When the user is in a standing position, it often becomes desirable to lean back and rest against the back wall of the bolster chair. The vertical position of the downwardly folded seat, however, often prevents such leaning or makes the leaning uncomfortable.

What is needed, then, is an easily foldable seat for a bolster chair that enables a standing user to lean back comfortably to rest against the back of the chair.

However, in view of the prior art considered as a whole at the time the present invention was made, it was not obvious to those of ordinary skill in the pertinent art how the identified need could be fulfilled.

SUMMARY OF INVENTION

The long-standing but heretofore unfulfilled need for an improved bolster chair is now met by a new, useful, and nonobvious invention. The novel bolster chair has a back wall and a pair of transversely opposed side walls. It further includes a foldable seat having a horizontal position adapted to support a seated user and an upwardly folded, vertical position so that a user may stand in a space bounded by the back wall and the pair of opposed side walls. A height adjustment means adjusts the height of the seat when the seat is in its upwardly folded, vertical position. A standing user may lean against the seat when the seat is in said upwardly folded, vertical position, and the vertical position of the seat is adjustable to accommodate users of varying heights.

A locking and unlocking means has a first position where it locks the seat in a first preselected position of vertical adjustment and has a second position where it unlocks the seat so that the seat may be moved to a second preselected position of vertical adjustment, while in the upwardly folded, vertical position, when desired by the user. When the seat is locked in a vertical, upwardly folded position of adjustment, it is also locked against unfolding into a horizontal position. When unlocked for vertical adjustment, it is also unlocked so that it can be positioned horizontally.

The locking and the unlocking means includes a gas spring in the form of a cylinder having a plunger that is retractable and extendable relative to the cylinder. A control means selectively retracts, extends and locks the plunger relative to the cylinder. A distal free end of the plunger is connected to the seat so that the seat is raised when the plunger is extended and so that the plunger is retracted when the seat is lowered. The control means includes a control rod means or commercially available substitute having a first end pivotally secured to a handle that is pivotally mounted to the seat and a second end disposed in controlling relation to the plunger so that the plunger is locked when the handle is in a first position and the plunger is movable when the handle is in a second position.

The handle of the locking and unlocking means is pivotally mounted to a preselected part of the seat and movable in a plane of the seat, or a plane closely parallel to said plane, between a locked position and an unlocked position. When in the locked position, the gas spring prevents vertical adjustment of the seat. When in the unlocked position, the gas spring facilitates vertical adjustment of the seat.

The locking and unlocking means further includes a pair of slideably mounted locking members having an extended position that locks the seat in its upwardly folded position and a retracted position that unlocks the seat so that the seat may be folded downwardly into a horizontal position.

A pair of guide tracks hold the seat in the horizontal position and in the vertical position. The guide tracks also guide the seat as it is displaced from the horizontal position to the vertical. position and from the vertical position to the horizontal position. Each guide track of the pair of guide tracks has an inverted "L" shape that includes a truncate part and an elongate part disposed normal to the truncate part.

The seat further includes a pair of transversely disposed frame members that form a part of the seat. A rotatably mounted roller or a non-rotatably mounted bushing, or other suitable guide track-engaging means, is disposed on opposite ends of each of the frame members. Each guide track-engaging means is disposed in the truncate part of the guide tracks when the seat is deployed in the horizontal position and each is disposed in the elongate part of the guide tracks when the seat is deployed in the vertical position. A first half of the guide track-engaging means is disposed in the truncate part of the guide tracks and a second half of thereof is disposed in the elongate part of the guide tracks when the seat is disposed in an intermediate position between the horizontal and vertical positions.

An important object of this invention is to provide a bolster chair having an adjustable seat.

A more specific object is to provide a seat that does not interfere with rearward leaning by a standing user of the chair.

Another specific object is to provide a bolster chair having an upwardly foldable seat that may be positioned into a plurality of functional positions of vertical adjustment when in its upwardly folded, vertical configuration.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
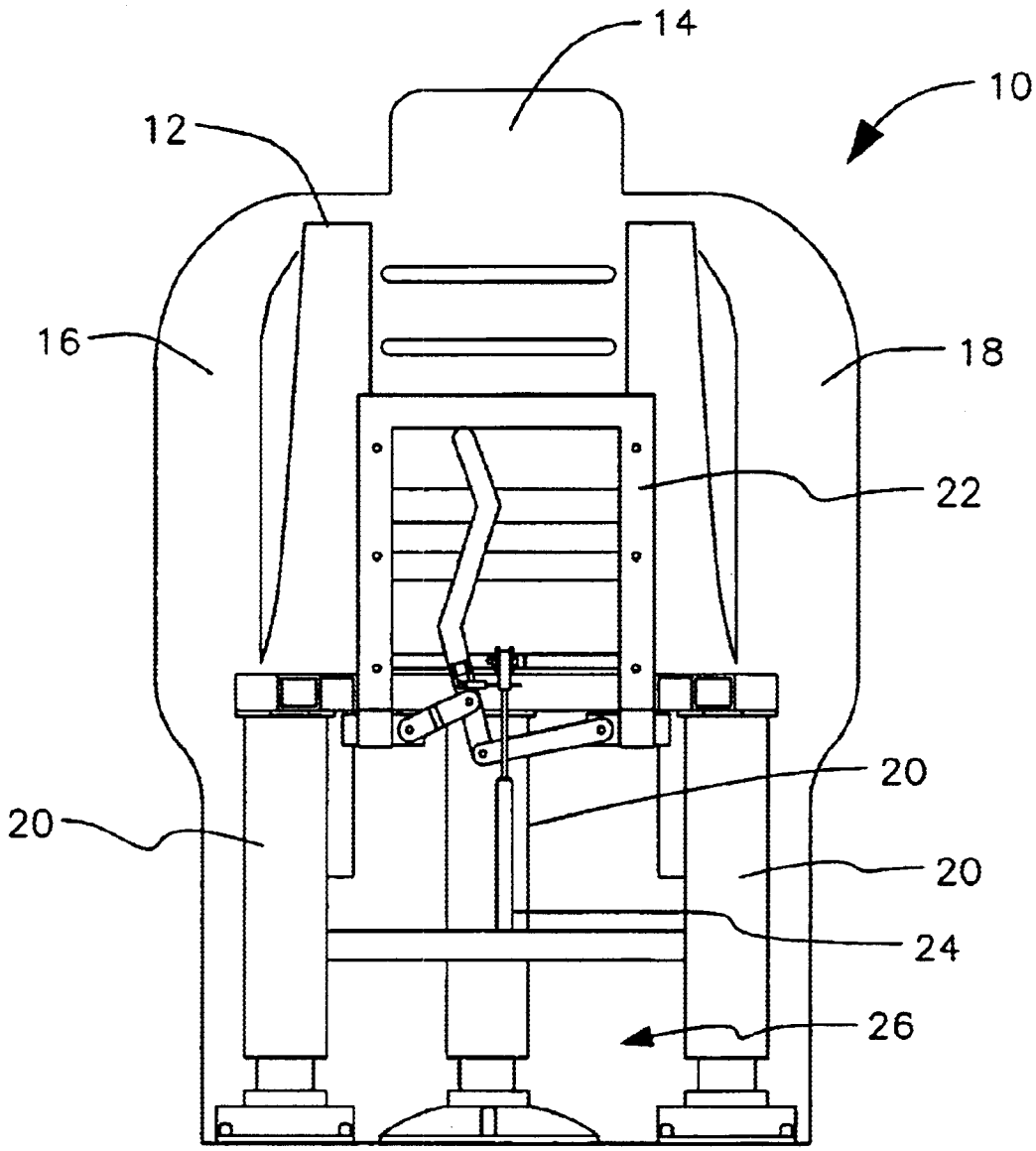
FIG. 1 is a front elevational view of a bolster seat equipped with the novel adjustable seat.

Referring to FIG. 1, it will there be seen that the reference numeral 10 denotes an illustrative embodiment of the present invention as a whole. Bolster chair 10 is heavily padded and includes back section 12 having a head rest 14 which has utility when a person is seated in said bolster chair. The side walls of the chair, denoted 16, 18 are also heavily padded. The side walls extend vertically from the top of back section 12 to the plane of the seat when the seat of the bolster chair is in its horizontal position. The side walls have a depth sufficient so support a person standing in front of the back wall if externally applied forces cause said person to fall towards either of said side walls. Three pedestals arranged in a triangular pattern, collectively denoted 20, support the frame of chair 10. A different number of pedestals could be used; the number of pedestals employed is not a critical part of this invention. Novel seat is denoted 22 as a whole and is depicted in its vertical, upwardly folded disposition. Gas cylinder or gas spring 24 is a part of the mechanism for raising and lowering seat 22 while in its vertical disposition.

When seat 22 is folded vertically as depicted in FIG. 1, a user may stand in area 26 that is bordered to the rear by seat back 12 and to the sides by members 16 and 18. The heavy padding prevents injury as the person is knocked to the rear and to the sides by the violent forces acting on the vehicle at high speeds.

Figure 2:
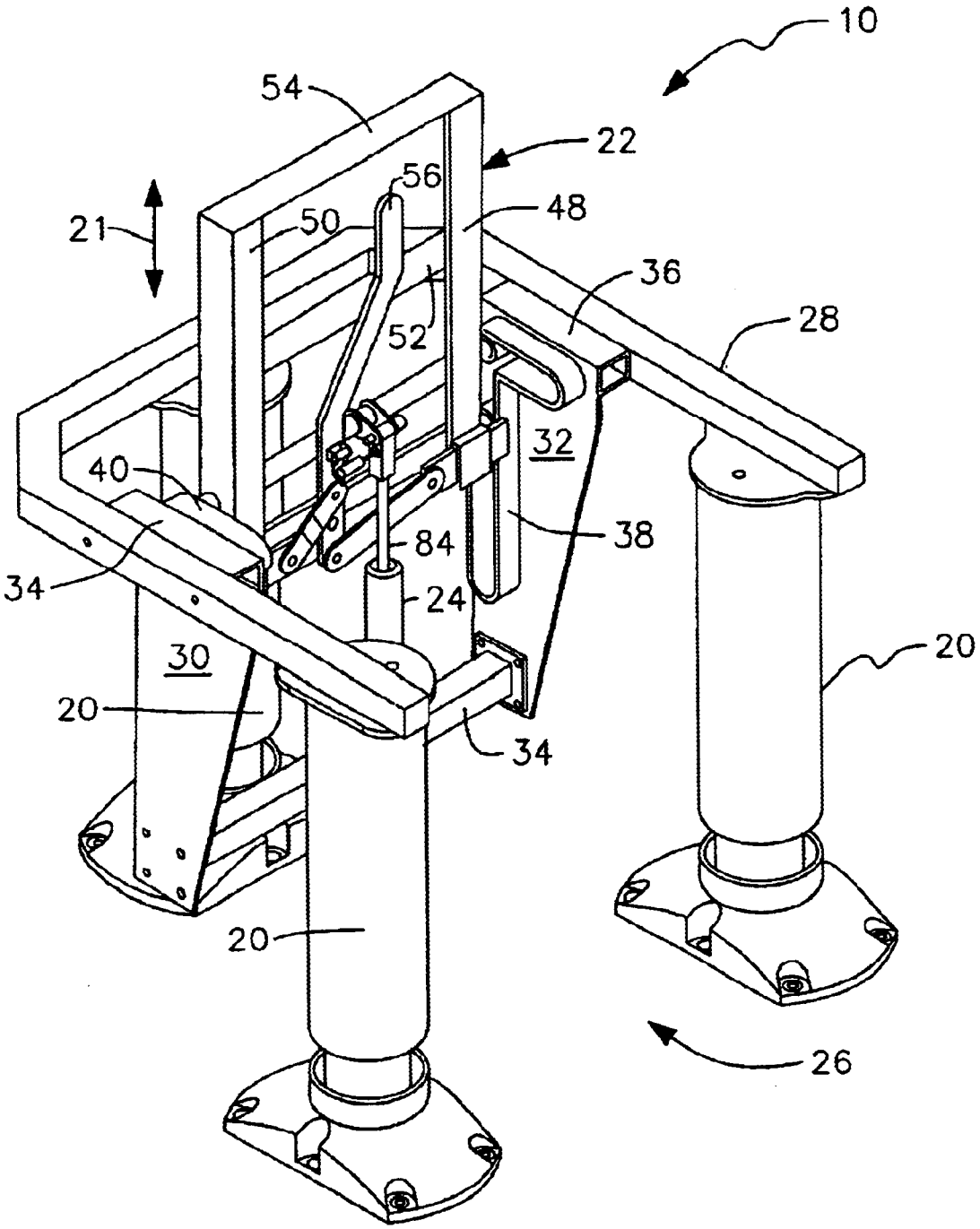
FIG. 2 is a perspective view of the novel bolster chair with cushioning removed.

As depicted in FIG. 2, a generally "U"-shaped frame 28 is supported at its transversely disposed forward ends and mid-length of its rearward side by pedestals 20.

Additional support for the novel seat is provided by flat legs 30, 32 that are interconnected to one another at their respective lowermost ends by transversely disposed box beam 34. The respective uppermost ends of said flat legs 30, 32 are secured to longitudinally disposed box beams 34, 36 and said box beams are secured to frame 28 as depicted.

Figure 3:
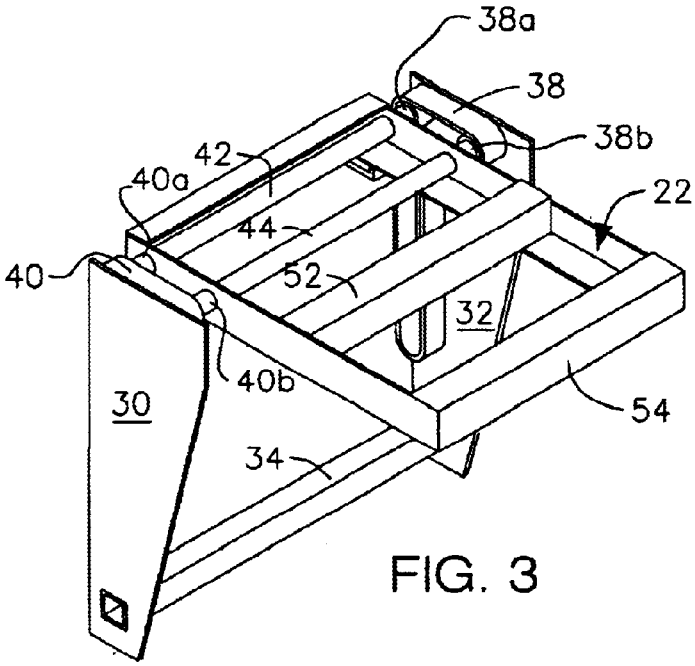
FIG. 3 is a perspective view of the seat in its horizontal position.
Figure 4:
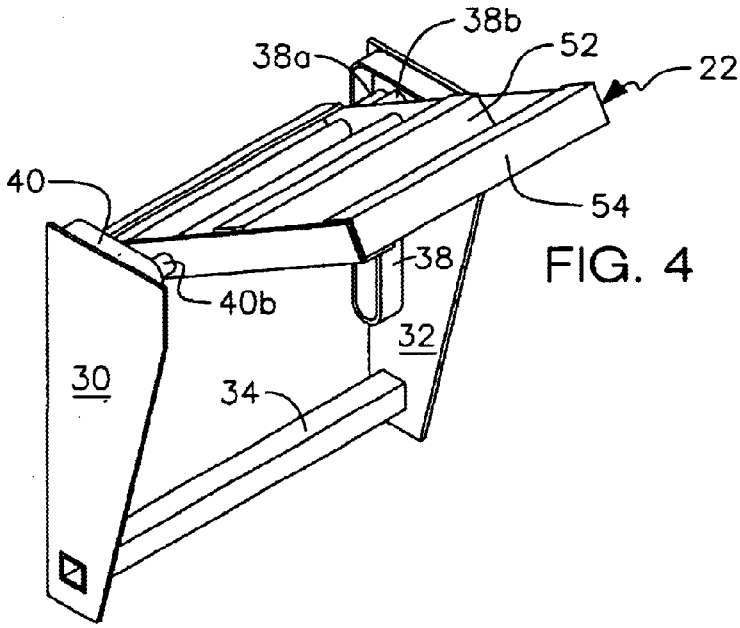
FIG. 4 is a perspective view of the seat in transition between its horizontal and vertical positions.

A guide track having an inverted "L"shape is mounted to the inboard side of each flat leg as at 38, 40. As perhaps best understood in connection with FIGS. 3, 4, and 5, guide tracks 38 and 40 are respectively engaged by a pair of roller members or bushing means or other suitable guide track-engaging means that are rotatably or non-rotatably mounted to opposite ends of transversely disposed seat back frame members 42, 44. As disclosed in FIG. 3, all four guide track-engaging means 38*a*, 38*b*, and 40*a*, and 40*b* are positioned in the truncate part of the inverted "L"-shaped guide tracks 38 and 40, respectively, when the seat is in its horizontal position. As suggested by FIG. 4, guide track-engaging means 38*a*, 40*a* are positioned in the elongate part of their respective guide tracks and guide track-engaging means 38*b*, 40*b* remain in said truncate part when said seat is in transition between its FIG. 3 position and its upright FIG. 5 position. All four guide track-engaging means are constrained by the long part of the respective guide tracks when the seat is in its FIG. 5 position.

Figure 5:
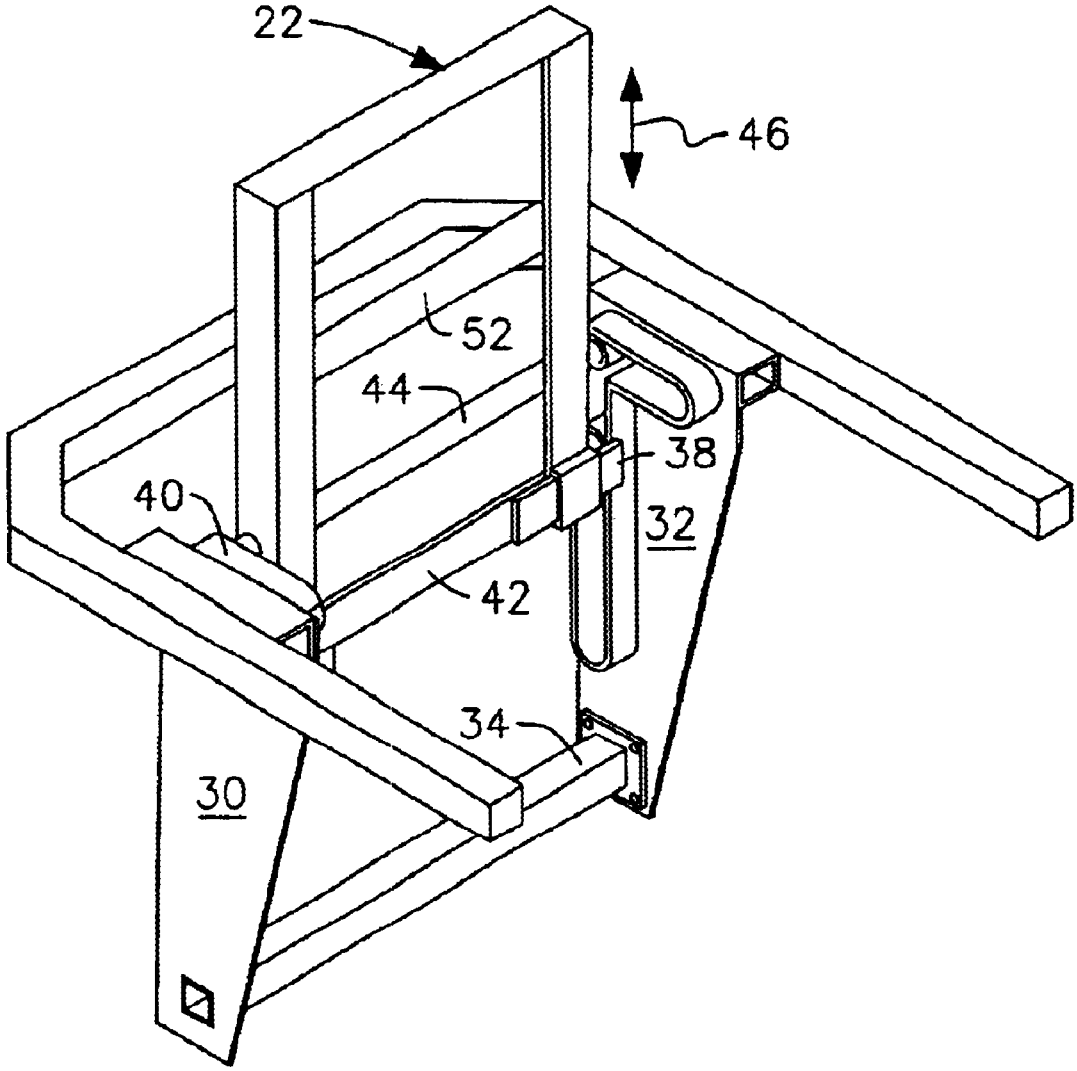
FIG. 5 depicts the seat in one of its vertical positions.

Significantly, as indicated by double-headed directional arrow 46 in FIG. 5, seat 22 is movable into and lockable in a plurality of positions of vertical adjustment when it is in its vertical disposition. This feature enables people of differing heights to lean against seat 22 when they are standing in space 26 due to violent forces acting on bolster chair 10.

Figure 6:
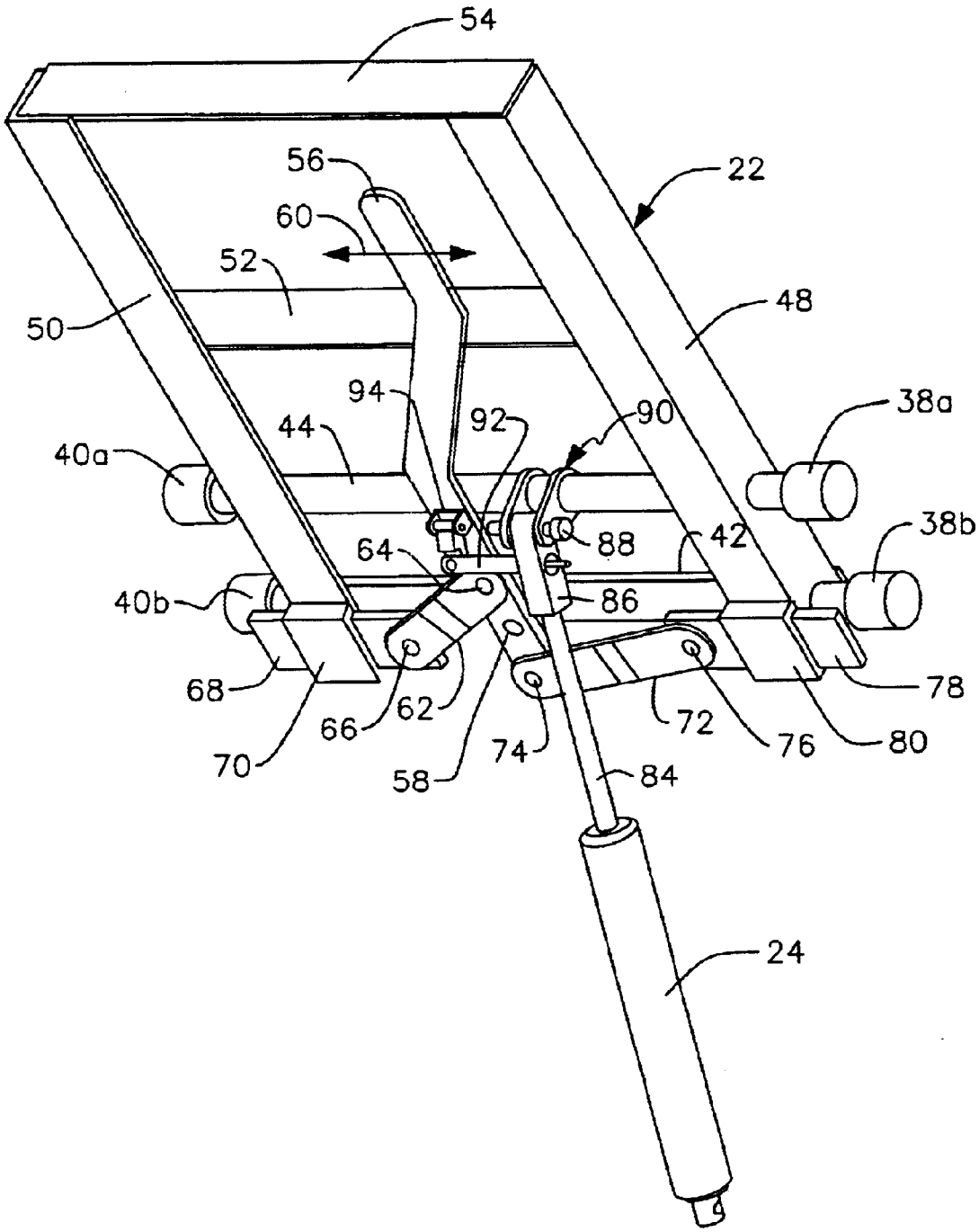
FIG. 6 is an enlarged view of the seat depicted with height adjustment means.

The parts that provide this important vertical adjustment are depicted in FIG. 2 but can be seen better in FIG. 6 which provides a slightly enlarged view of seat 22 and the parts that provide the height-adjusting feature.

The frame of seat 22 includes side frame members 48 and 50 which are parallel to one another and which are interconnected by transversely disposed connecting members 52, 54.

Handle 56 is pivotally mounted as at 58 to frame member 42 and is movable in the plane of the paper as indicated by double-headed directional arrow 60. Rigid link 62 has a first end pivotally secured to handle 56 as at 64 and a second end pivotally secured as at 66 to locking bar 68 which is slideably mounted within retainer 70 that is mounted to side frame member 50 at its lowermost end. In the same way, rigid link 72 has a first end pivotally secured to handle 56 as at 74 and a second end pivotally secured as at 76 to locking bar 78 which is slideably mounted within retainer 80 that is mounted to side frame member 48 at its lowermost end.

Accordingly, displacement of handle 56 to the right as drawn in FIG. 6 causes retraction of locking bars 68, 78, i.e., said locking bars move from their extended positions as depicted in said FIG. 6 to retracted, inboard positions where they are substantially fully received within their respective retainers 70, 80. When said locking bars are so retracted, seat 22 is movable up and down as indicated by double-headed directional arrow 21 in FIG. 2. When extended, as depicted in FIG. 6, locking bars 68, 78 abut inverted "L"-shaped guide tracks 40 and 38, respectively, and prevent seat 22 from being folded downwardly into its horizontal position because said seat is behind said locking bars.

Gas spring 24 assists in the raising and lowering of seat 22 when plunger 84 is unlocked and serves to lock the seat against vertical adjustment when plunger 84 is locked. The distal free end of plunger 84 is received within hollow box beam 86 and the uppermost end of said box beam is pivotally mounted as at 88 to clevis member 90 that is fixedly secured to back frame member 44. Thus, extension of plunger 84 causes upward travel of seat 22 and retraction of plunger 84 occurs during downward travel of said seat, it being understood that such travel is possible only when seat 22 is in its upright position as mentioned earlier.

More particularly, retraction, extension, and locking of plunger 84 is under the control of control rod 92 in this particular embodiment. A first end of control rod 92 is secured to mounting block 94 which is mounted to handle 56 and a second end of control rod 92 is received within hollow box beam 86, said box beam being apertured as illustrated to receive said second end. When handle 56 is displaced to the right in FIG. 6 as drawn, control rod 92 is displaced to the right, thereby releasing plunger 84 so that the vertical height of the seat may be adjusted. Locking bars 68, 78 simultaneously retract when said handle is deployed to the right, thereby enabling the seat to rotate into its horizontal position as mentioned above. When handle 56 is manually displaced to the left as drawn in FIG. 6, extending locking bars 68, 78, control rod 92 is displaced to the left and plunger 84 is locked, thereby preventing vertical motion of seat 22. Thus, two locking actions occur when handle 56 is displaced to the left as drawn.

Control rod 92 and gas spring 24 are commercially available. Control rod 92 may be replaced by other suitable, commercially available control means having utility in controlling gas springs.

Seat 22 when folded upwardly provides an additional support means against which a user can lean when standing in space 26. Due to the length of the elongate part of guide tracks 38, 40, seat 22 can be positioned in a low position for a short person, in a high position for a tall person, and at many in-between positions for others.

Significantly, seat 22 cannot be folded into its horizontal position when it is locked into a preselected position of vertical adjustment by gas spring 24. When the gas spring is released to enable vertical adjustment of seat 22, the seat then may be deployed into its horizontal position.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. A bolster chair, comprising:

a seat having a horizontal position adapted to support a seated user;

an upstanding back wall positioned rearwardly of said seat;

a pair of upstanding, transversely opposed side walls positioned on opposite sides of said seat, each side wall being disposed at a right angle to said back wall, and each side wall having a depth sufficient to support a person standing in front of said back wall if external forces cause said person to fall towards either side wall;

each side wall extending vertically from a top of said back wall to a plane occupied by said seat when said seat is disposed in said horizontal position so that a person standing forwardly of said back wall is protected from falling to either side by said side walls;

said seat having an upwardly folded, vertical position so that a user may stand in a space bounded by said back wall and said pair of opposed side walls when said seat is in said upwardly folded, vertical position;

height adjustment means for adjusting the height of said seat when said seat is in said upwardly folded, vertical position;

a locking means having an unlocked position and a locked position;

said locking means when in said unlocked position enabling said height adjustment means to adjust the height of said seat when said seat is in the upwardly folded, vertical position;

said locking means when in said locked position preventing said height adjustment means from adjusting the height of said seat; and said locking means when in said locked position preventing deployment of said seat in said horizontal position;

whereby a standing user may lean against said seat and said side walls when said seat is in said upwardly folded, vertical position; and whereby said upwardly folded, vertical position of said seat is adjustable in a vertical plane to accommodate users of varying heights.

2. The bolster chair of claim 1, further comprising:

said height adjusting means including a cylinder having a plunger that is retractable and extendable relative to said cylinder;

a control means for selectively retracting and extending said plunger relative to said cylinder; and said plunger being connected to said seat so that said seat is raised when said plunger is extended and so that said seat is lowered when said plunger is retracted.

3. The bolster chair of claim 2, wherein said locking means includes a handle that is pivotally mounted to a preselected part of said seat and movable in a plane of said seat between a said locked position and said unlocked position.

4. The bolster chair of claim 3, wherein said locking means includes a pair of slideable mounted locking members having an extended position that locks said seat in said upwardly folded, vertical position and a retracted position that unlocks said seat so that said seat may be folded into a horizontal position.

5. The bolster chair of claim 4, wherein said control means includes a control rod, said control rod having a first end pivotally secured to said handle and a second end disposed in controlling relation to said plunger so that said plunger is locked against movement when said handle is in said locked position and said plunger is movable when said handle is in said unlocked position.

6. The bolster chair of claim 1, further comprising:

a pair of guide tracks for holding said seat in said horizontal position and in said vertical position, and for guiding said seat as the seat is displaced from said horizontal position to said vertical position and from said vertical position to said horizontal position;

each guide track of said pair of guide tracks having an inverted L-shape that includes a truncate part and an elongate part disposed normal to said truncate part.

7. The bolster chair of claim 6, further comprising:

a pair of transversely disposed frame members that form a part of said seat, said pair of frame members including a first frame member and a second frame member;

a roller member disposed on opposite ends of each frame member of said pair of frame members;

each roller member being disposed in said truncate part of said guide tracks when said seat is deployed in said horizontal position;

each roller member being disposed in said elongate part of said guide tracks when said seat is deployed in said vertical position;

said roller members of said first frame member being disposed in said truncate part of said guide tracks and said roller members of said second frame member being disposed in said elongate part of said guide tracks when said seat is disposed in an intermediate position between said horizontal and vertical positions.

* * * * *